United States Patent [19]

Adam

[11] Patent Number: 4,741,537

[45] Date of Patent: May 3, 1988

[54] TEEING DEVICE

[76] Inventor: Alvin R. Adam, 490-42nd St. #8, Oakland, Calif. 94609

[21] Appl. No.: 771,692

[22] Filed: Sep. 3, 1985

[51] Int. Cl.[4] ..... A63B 57/00

[52] U.S. Cl. ..... 273/201; 124/50; 124/51 A

[58] Field of Search ..... 273/201, 29 A, 26 R, 273/359, 369, 399, 184 R, 186 R; 124/51 R, 45-50, 41 R, 16, 60, 51 A; 269/20, 21, 24, 30, 22; 209/434

[56] References Cited

*U.S. PATENT DOCUMENTS

| | | | |
|---|---|---|---|
| 2,312,244 | 2/1943 | Feltman | 124/51 A |
| 2,618,480 | 11/1952 | Williams | 273/201 |
| 3,448,985 | 6/1969 | Scott | 273/201 |
| 3,458,204 | 7/1969 | Wilson | 273/201 |
| 3,612,027 | 10/1970 | Makino | 124/16 |
| 3,786,919 | 1/1974 | Deringer | 209/43 X |
| 4,132,214 | 1/1978 | Schnurr et al. | 124/50 |
| 4,237,851 | 12/1980 | Haller | 124/41 R |
| 4,253,668 | 3/1981 | Ose | 273/201 |

FOREIGN PATENT DOCUMENTS

| | | | |
|---|---|---|---|
| 3339622 | 6/1984 | Fed. Rep. of Germany | 124/50 |
| 608967 | 9/1960 | Italy | 124/50 |
| 7713646 | 6/1979 | Netherlands | 209/434 |
| 374052 | 5/1932 | United Kingdom | 273/201 |

*Primary Examiner*—Richard C. Pinkham
*Assistant Examiner*—T. Brown
*Attorney, Agent, or Firm*—Warren J. Krauss

[57] ABSTRACT

An apparatus for semiautomatically teeing up golf balls utilizing very low air pressure as an operating medium. Balls are loaded onto a contoured dish at the upper end of an open ended upright cylinder and pass from the dish into a flexible tube wrapped helically around the outside of the cylinder. The lower end of the tube is blocked by a ball dispenser. When a user trips a lever on the ball dispenser, one ball is permitted to roll to a stop above a hole in the hitting mat directly above the air operated teeing device. The teeing device includes a teeing tube attached vertically above an expandable chamber and extending just to the top surface of the hitting mat. A very low pressure stream of air constantly flows through the chamber and escapes via the teeing tube. When a golf ball comes to rest above the teeing tube, the escape of air is terminated, causing the expandable chamber to fill, thereby raising the teeing tube and the ball to the teed height. When the golf ball is struck from the teeing tube, the air again escapes from the expandable chamber, causing the teeing tube to recede into the hole in the hitting mat ready for the next ball to be teed.

23 Claims, 4 Drawing Sheets

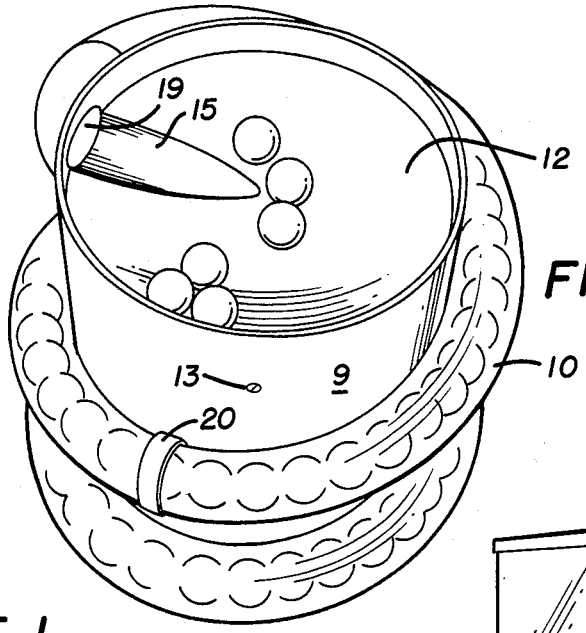
FIGURE 2
FIGURE 1
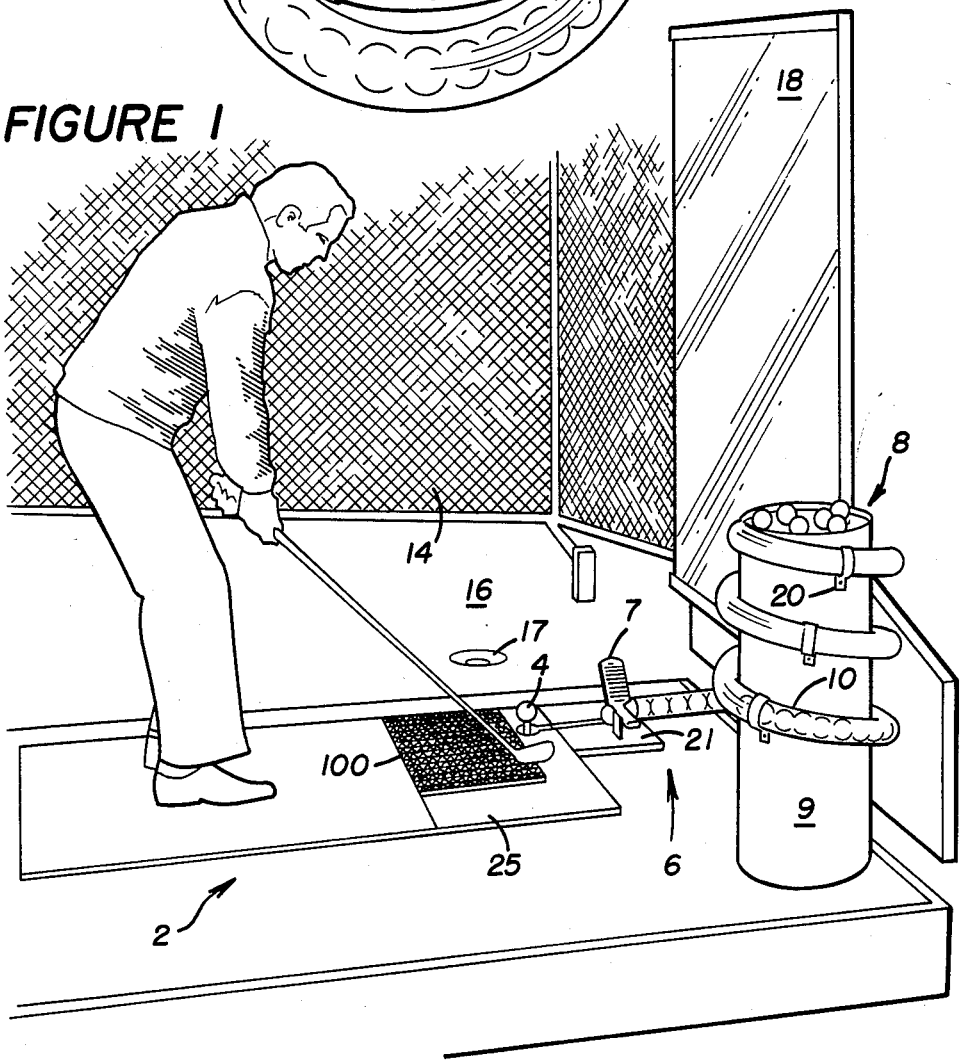

TEEING DEVICE

BACKGROUND OF THE INVENTION

This invention relates to an apparatus and system for semi-automatically teeing-up golf balls for practice purposes. With the increasing popularity of golf, practice facilities are in rising demand and those commercial driving ranges having the most efficiently operated modern equipment will prevail in the market.

A basic ingredient in improving one's golfing skill is the analytical, repetitious use of various clubs, stances, and hand grips in practice. The use of commonly available practice equipment at typical driving ranges, however, at least partially defeats this type of practice. That is, state-of-the-art facilities require the golfer to tee-up his golf balls manually. This means that after every shot, the golfer is forced to bend over, remove his hand from his club grip, reposition his feet, remove the ball from a holding container and place it manually upon a tee.

Not only does this manual method require release of the club and variance of one's stance, with concommitant inability to duplicate these parameters in the ensuing shot, but it can prove arduous for older golfers and those with physical handicaps. It also obviously destroys any tempo which the golfer might wish to develop in his practice swings.

With the apparatus of the present invention, the golfer can hit more than 100 balls off a tee without once bending over, changing his stance, or his grip. With it, the golfer can make minute adjustments in grip or stance and study the effects thereof upon ball trajectory.

There have been numerous attempts in the prior art for providing automatic or mechanically-assisted golf ball teeing devices. As evidenced by the reluctance of the proprietors of commercial driving ranges to employ these inventions, however, it is clear that the prior art systems have not been accepted for a variety of reasons including undue complexity, unmerited cost, and difficulty in installation. The durable, simple and inexpensively fabricated present invention, on the other hand, is directly adaptable to the equipment presently installed in commercial driving ranges and requires only minimal expense in adaptation and installation procedures.

Some of the prior art systems have attempted to address some of the individual problems solved by the present invention. None, however, has even contemplated the need for the overall combination presented. For example, U.S. Pat. No. 4,360,204 to Karr teaches a reservoir and cylinder for holding golf balls in a teeing machine. In Karr, a spiral-shaped open-track is provided with a given slope to feed balls into a rather complicated electrically-operated teeing device. The Karr open-track reservoir system, however, which is representative of the prior art, is susceptible to jamming and permits ball dislodgement. Another open-track ball supply system is shown in U.S. Pat. No. 4,177,996 to Chang.

Another example of a prior art teeing device is U.S. Pat. No. 2,643,883 to Hogeberg. In a system of electrically controlled circuitry, Hogeberg uses negative air pressure or vacuum to force a golf ball to adhere to a tee. The Hogeberg device and those shown in U.S. Pat. Nos. 2,051,253 and 3,378,263 to Goehler, et al. and Turnau, et al., respectively, are typical of the complicated valve controlled pneumatic systems utilized in the prior art.

The prior art, in its complexity and susceptibility to operational difficulties, illustrates why there has not been in the past a large market for semi-automatic golf teeing systems.

In contradistinction to the prior art systems, the present invention comprises a simple apparatus, having only two moving components, which cheaply and efficiently stores and dispenses more than a hundred golf balls. It selectively delivers balls to a normally retracted tee means which automatically lifts upon demand to a desired tee height. The system may be installed within hours in private facilities or in commercial driving ranges and the cost of the very low positive air pressure supply which lifts the tee means amounts to only that of running a motor for a fan having the capacity of a common household vacuum cleaner.

SUMMARY AND OBJECTS OF THE INVENTION

The present golf-teeing apparatus comprises golf ball storage and feeding means in combination with tee-lifting means which are selectively actuatable for smoothly and efficiently placing golf balls upon a tee at a desired height without need for adjustment of the golfer's stance or handgrip. The storage means comprise closed flexible tubing formed as a helix around an upstanding cylinder for storing and delivering a large plurality of balls individually to selectively operable feeding means. The feeding means comprise a simple rocking bar and strategically placed stops and rolling means for delivering one ball at a time, upon demand, to a hitting mat and the tee-lifting means. The tee-lifting means is actuated by a supply of very low positive air pressure in the range of 2 inches water operating upon an expandible chamber disposed beneath the hitting mat. A tee protrudes through an orifice in the hitting mat and automatically lifts the ball to a preselected height as soon as a ball is delivered to the mat orifice by the feeder means.

A primary object of the present invention is to provide a semi-automatic ball teeing apparatus which enables a practicing golfer to selectively place a large plurality of golf balls successively upon a tee at a desired height without bending, moving his stance, or releasing his handgrip.

Another object of the present invention is to provide a pneumatically actuated tee which reciprocates through an orifice in a hitting mat under the influence of very low positive air pressure and which, immediately upon removal of a golf ball from the tee, will drop down through the mat orifice, positioned to receive another ball.

Still another object of the present invention is to provide a golf ball teeing apparatus having means for adjusting the height to which a ball is teed through an infinitely variable range.

A further object of the present invention is to provide a golf teeing apparatus which operates semi-automatically but which can be converted to a purely manual system when desired.

Another object of the present invention is to provide a golf teeing apparatus having a small number of moving parts which is inexpensively fabricated and readily installable in the present structures of typical commercial golf practice ranges.

Other objects and advantages of the present invention will become apparent from the following drawings and description.

The accompanying drawings show, by way of illustration only, the preferred embodiment of the present invention and the principles thereof. It should be recognized that other embodiments of the invention, applying the same or equivalent principles, may be used and that structural changes may be made as desired by those skilled in the art without departing from the spirit of the invention.

BRIEF DESCRIPTION OF THE DRAWINGS

FIG. 1 is an isometric general view of the apparatus which is the subject of this invention showing it in use by a practicing golfer;

FIG. 2 is an isometric plan view of the storage means of the present invention;

DETAILED DESCRIPTION

Figure 3:
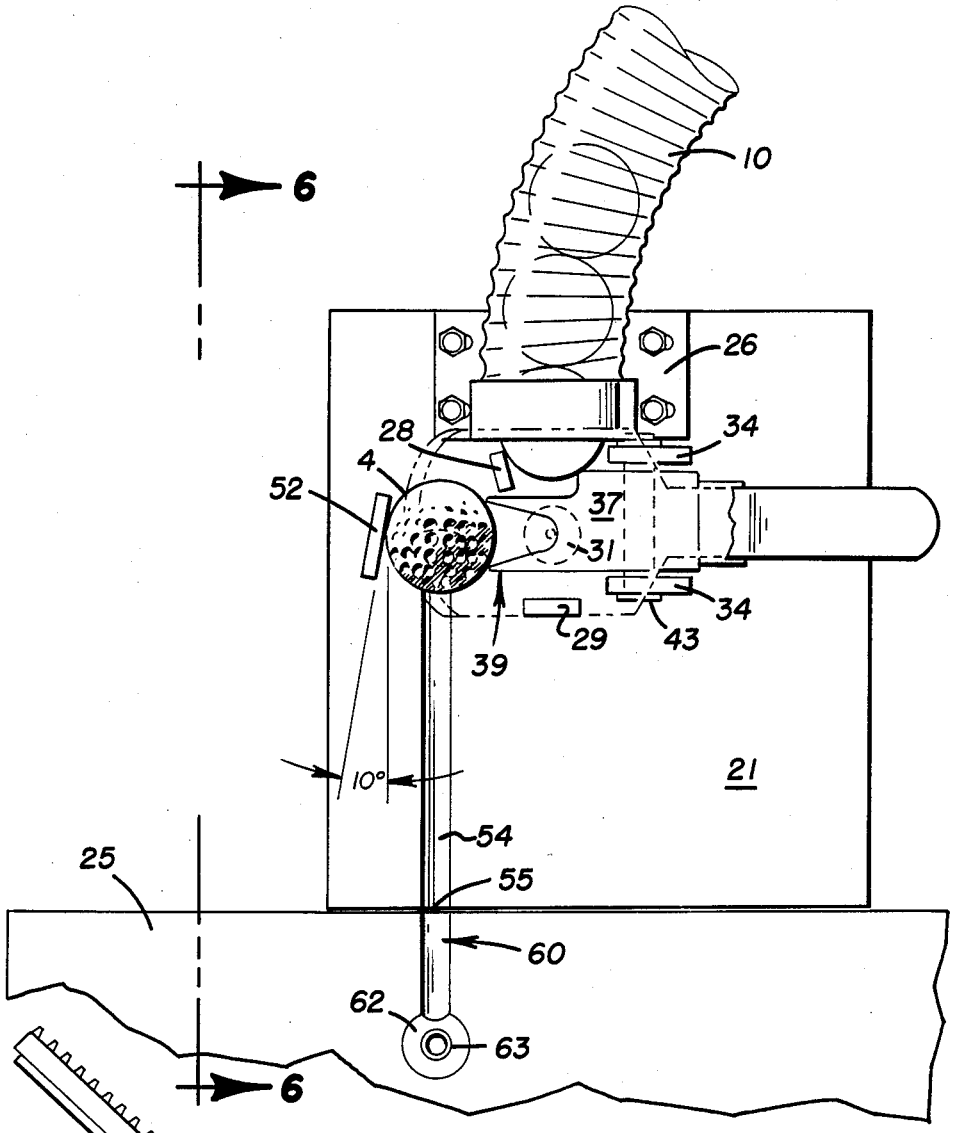
FIG. 3 is a plan view of the feeder means of the present invention with the rocking arm pedal cut away for better viewing of components.

With reference to FIG. 1 in the drawing, a general view of the present apparatus in its operative context is presented. A golfer is shown standing upon a hitting mat structure shown generally at 2, and is ready to strike a ball 4 which has been raised to teed height by the pneumatic lifting means of the present invention.

The feeder means of the present invention are shown generally at 6. They include a pedal 7 which the golfer depresses with his club head when he wishes to have a ball sent by the feeder means to the teeing means.

The storage means of the present invention is shown generally at 8. Such means include an upstanding cylinder 9 for holding a supply of balls at a reservoir top portion thereof and flexible closed tubing, preferably transparent, formed as a helix for supplying stored balls to the feeder means 6.

The general apparatus also includes screen means 14 for limiting the travel of balls hit from the practice tee, a sloped return surface 16, and collector means 17 for retrieving balls for further use. At 18 is shown mirror means which serve the dual function of enabling the golfer to see his stance and grip while preventing the flight of a possibly errant shot in a direction other than toward the collecting screen 14.

With reference to FIG. 2, the structure of the ball storage system and reservoir may be readily appreciated. The upstanding cylinder 9 is hollow and may be used for storage of golf paraphernalia. Access to the hollow interior of the cylinder is provided by removal of the contoured top dish 12, made of wood or other formable material, which is recessed within the cylinder and supported by a plurality of screws or other suitable support means 13.

Golf balls from a large portable container are poured onto the dish surface and assume the positions shown. They are prevented from rolling off the dish by the interior walls of the cylinder 9 within which the dish is recessed, as clearly shown in FIG. 2. The contoured dish includes a feeder channel 15 which is formed to closely approximate the circumference of a golf ball and which terminates in alignment with aperture 19 in the wall of the cylinder 9.

Attached wrappingly around the cylinder and affixed so that it is open to the aperture 19, is the flexible feeder tubing 10 of the present invention. The tubing is suitably attached to the upstanding cylinder by means of the plurality of clips or other fastening means 20, such that it is formed as a helix with a downward slope or drop of approximately 1.8 inches per foot of tubing. In the typical installation shown on FIG. 1, the storage reservoir for holding 100–125 golf balls would include a length of approximately 14 feet of flexible tubing 10 and the cylinder 9 would have a diameter of approximately one foot. In operation, balls which are poured into the top dish 12 are directed by the force of gravity into the channel 15 and through the aperture 19 to completely fill the flexible tubing 10, as shown in phantom in FIGS. 1 and 2.

Now with particular reference to FIGS. 3–6, the feeder means which control transit of the balls stored in flexible tubing 10 to the ball teeing means will be described. The feeder means include a base member 21 of stainless steel, plastic or other durable, weather-resistant material. The base is equal in thickness to that of the adjacent hitting mat 25.

To the base 21, is clamped or otherwise affixed by fastener means 26, the flexible tubing 10. By manipulating the adjusting means 26, the outlet of the tubing 10 may be positioned with respect to the complementary elements of the feeder means.

Figure 5:
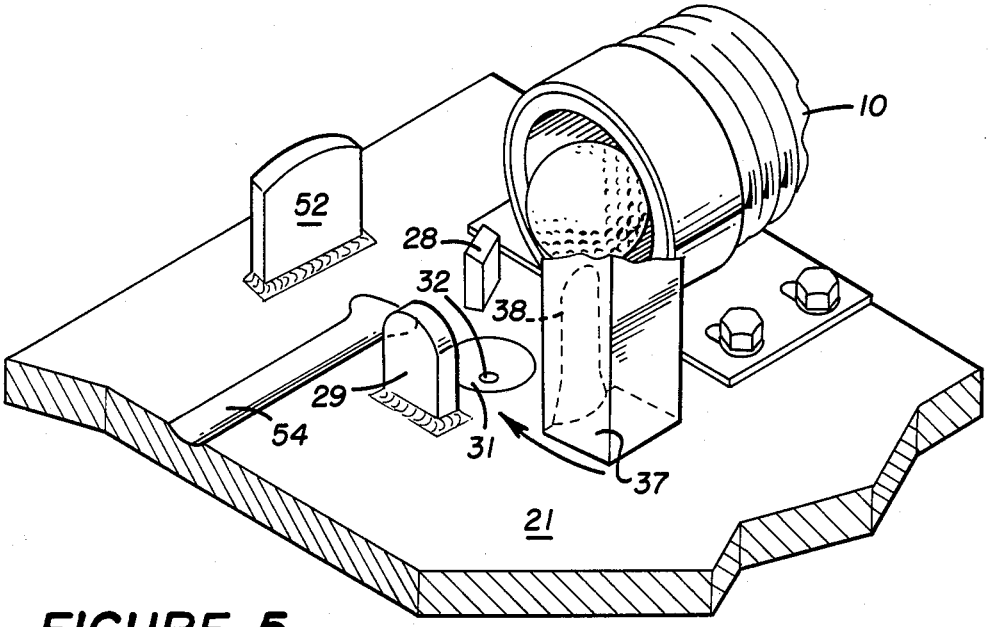
FIG. 5 is an isometric view of portions of the feeder means showing a ball exiting the storage tubing.
Figure 6:
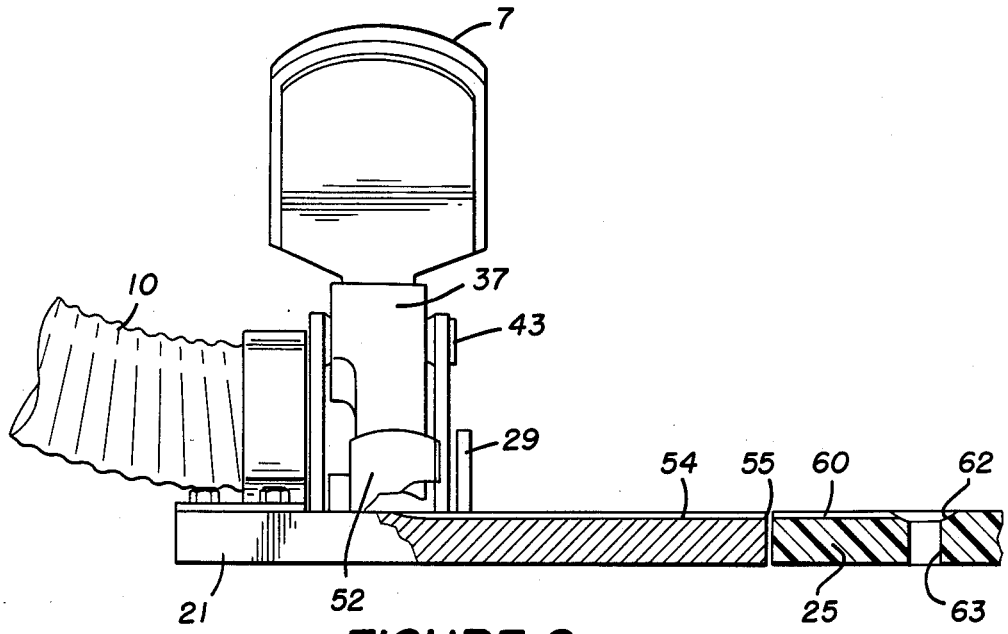
FIG. 6 is a front view of the feeder means taken along the line 6—6 in FIG. 3.

As shown clearly in FIGS. 3 and 5, a deflector plate 28 is disposed immediately adjacent to the outlet of the tubing 10 for directing balls issued therefrom against a stopping plate 29. A ball striking the stopping plate 29 will come momentarily to rest in a depression 31 milled into the base 21. A drain hole 32 prevents the accumulation of water in the depression 31.

Figure 4:
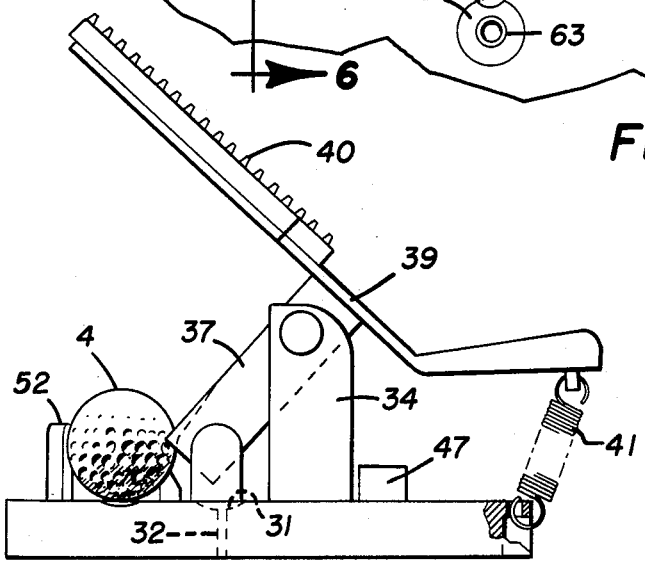
FIG. 4 is an elevation of the feeder means showing a ball held in ready position by the rocking arm.

A pair of upstanding support plates 34 are, by suitable means such as welding, affixed to the base 21. These supports pivotally suspend a rocking arm member 37 upon a pin 43. As best shown in FIGS. 3–5 at 38, the surface of the rocking arm which contacts a golf ball 4 is contoured to conform to the curvature of the golf ball to control the travel of the ball through the feeder means.

Attached to the rocking arm member 37 is a pedal bar member 39 which is biased to the position shown in FIG. 4 by means of a tension spring 41 fixed between the member 39 and the base 21. Also affixed to the base is a terminal stop bar 52 which serves the dual functions of stopping and directing balls which are urged by the rocking arm 37 away from the depression 31 to the proximal end of a transit groove 54 in the base 21. The terminal stop bar 52 is set at an angle of approximately 10 degrees with respect to the pivot axis of the pin 43 for the rocking arm 37.

The transit groove 54 has a short sloping section at its proximal end and is then generally of uniform depth to its distal end 55 at the edge of the base 21. It may be noted, however, that the sloping proximal end of the groove is slightly flared to urge any ball which is not tightly positioned against stop bar 52 to enter the transit groove. The slight drop in height from the surface of the base 21 to that of the transit groove 54 provides sufficient impetus for a ball to roll along the transit groove to a complementary mat groove 60 in the hitting mat 25. The ball will roll along the mat groove 60 to a depression 62 and an orifice 63 in the mat 25 for a purpose to be described presently.

Figure 8:
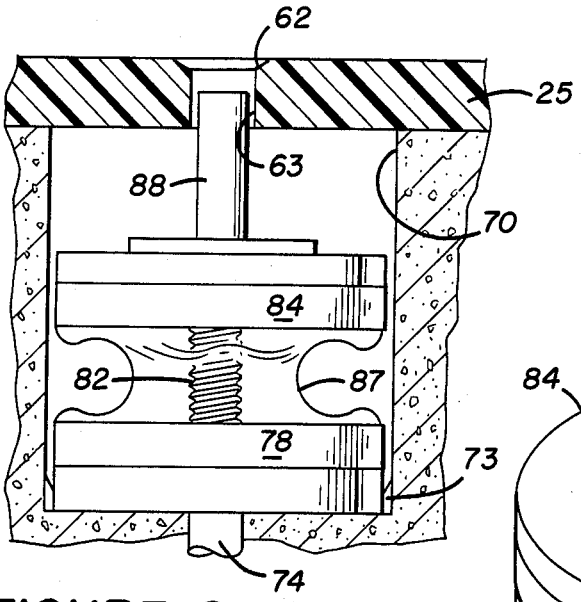
FIG. 8 is a partial sectional view of the hitting mat and the teeing means showing the expandable chamber in its retracted or collapsed ball-ready position.
Figure 7:
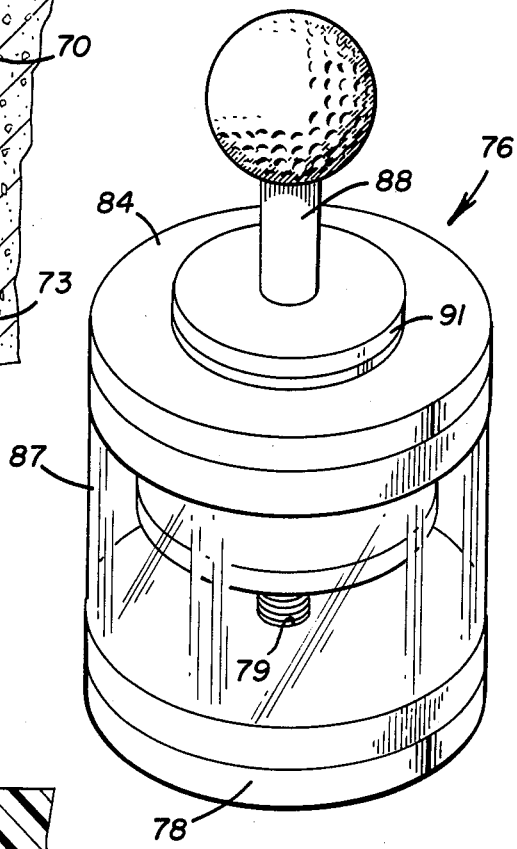
FIG. 7 is an isometric view of the expandable chamber element of the teeing means shown lifting a ball.
Figure 9:
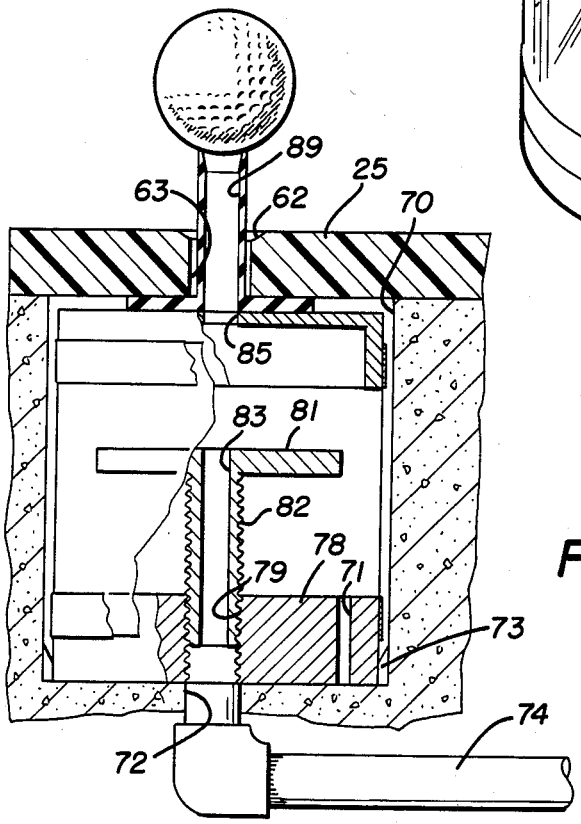
FIG. 9 is a view similar to FIG. 8, but showing the teeing means in its raised position.

Now with reference to FIGS. 7–9, the teeing means or ball-lifting components of the present invention may be readily appreciated.

Disposed beneath the hitting mat 25 and sharing a common center line with the mat orifice 63 is a cylindrical recess 70 formed in the concrete or other support material for the mat 25. The recess 70 can be formed directly in the support material or can take the form of an insertable cylinder of plastic or other suitable material. It is critical for the operation of the device that the bottom or base of the cylindrical recess 70, as shown in FIGS. 8 and 9, be generally flat and smooth and that the walls of the recess be smooth. Three equally spaced bevelled positioning nubs 73 are fixed to the inside wall of the recess 70 at its base. The nubs act to center the expandable air chamber 76 to ensure a working clearance between it and the recess 70.

At the base of the cylindrical recess 70, through a centered aperture 72 therein, is supplied a constant flow of low pressure air from an air supply line 74.

Disposed within the recess 70 is the flexible, expandable air chamber shown generally at 76 in FIG. 7. This air chamber is shown inflated in a ball-raised position in FIGS. 7 and 9 and is shown in deflated condition in FIG. 8.

The base 78 of the inflatable chamber 76 is a solid disk of metal or equivalent material having a smooth bottom surface and a threaded hole 79 disposed centrally thereof. A drain passage 71 is provided to prevent the accumulation of water in the chamber 76. The diameter of the base 78 is slightly less than that of the walls of the cylindrical recess 70 and it is centered by the nubs 73, so as to permit relative movement thereof.

Threaded into the hole 79 is a pipe 82 affixed flaringly to a smooth circular platform 81 at its upper end and having a passage 83 therein for air from the supply line 74 therethrough. By threading the pipe 82 in and out of the hole 79, the distance between the platform 81 and the base 78 may be selectively regulated.

The expandable chamber is also provided with an upper portion 84 which is essentially a short hollow cylinder open at the bottom and which, like the base, is centrally perforated at 85 for the passage of air therethrough. The expandable chamber 76 is completed by sealingly affixing between the base 78 and the upper portion 84 a flexible cylindrical wall or membrane of plastic or other like material 87. The flexible wall or membrane 87 permits relative movement between the upper portion 84 and the base 78 as shown in FIGS. 7 and 8 in extended and contracted conditions, respectively.

Glued or otherwise suitably affixed to the upper portion 84 is a tee 88 of hollow, flexible tubing made of rubber or equivalent material and having a tee-cross section with a pedestal portion and an upstanding portion as shown in FIG. 7.

As shown in FIG. 9, a clear air passage exists from the supply line 74 through the platform passage 83 and the perforation 85 in the upper portion 84 extending through the tee orifice 89.

FIGS. 8 and 9, showing the tee 88 in its lowered and raised positions, also disclose the operation of the teeing means. It should be noted that the mat orifice 63 is sufficiently large that the tee can move up and down therethrough without binding. The uppermost position or height of the tee with respect to the mat 25, as shown in FIG. 9, can be varied by placing one or more lightweight washer-like spacers 91 over the upstanding portion of the tee 88 in contact with the pedestal portion thereof, as shown clearly in FIG. 7. As the number of spacers 91 used is increased, the distance between the spacer and the underside of the mat 25 decreases, thus decreasing the vertical height of the tee 88 when it is fully extended through the mat orifice 63.

The air supplied through the line 74 is produced by a very low pressure blower, such as the fan from a common vacuum cleaner, and is supplied to one or a plurality of lines 74 for a plurality of on-site teeing systems, if desired.

The invention also includes, as shown in FIG. 1, a synthetic grass inset 100 laid into a recessed area of the hitting mat 25 in a position in which it will not interfere with practice shots from the raised tee 88 and where it will permit facile transfer of balls from the tee 88 onto the grass inset upon the touch of a golf club. The synthetic grass inset can be removed or rotated as desired to accommodate wear in use.

In operation, the apparatus is first loaded with a plurality of golf balls constituting the supply for the reservoir or storage means 8. The balls roll into the flexible tubing 10, as previously described, and proceed into the feeder means where they are blocked by the rocking arm 37, as shown in FIG. 3.

If the practicing golfer wishes to release a ball to be teed up, he merely uses the head of his club to depress the padded portion 40 of the pedal bar 39. As may be readily seen in FIGS. 3–6, depression of the padded portion 40 of the pedal bar 39 rotates the rocking arm 37 about the pivot pin 43 and causes the rocking arm 37, with its contoured portion 38, to rotate counterclockwise out of the path of balls issuring from the outlet of the flexible tubing 10. Counterclockwise rotation of the rocking arm 37 is limited by a stopping block 47, as best shown in FIG. 4.

With the ball path thus unblocked, a single ball exits the tubing 10 and is deflected by the deflector bar 28 into the depression 31 and against the ball stop plate 29. As the golfer then releases his club head from the padded portion 40, the spring 41 urges the rocking arm in a clockwise direction around the pivot 43 and pushes the ball which had been in the depression 31 to the position in which it is shown in FIGS. 3 and 4. In this position, the ball is firmly held by the contoured portion 38 of the rocking arm 37 against the terminal stop bar 52 and cannot move. It should be noted that in this position, the rocking arm 37 is again blocking egress of the next ball in sequence from the outlet of the flexible tubing 10, as clearly shown in FIG. 3.

With balls in the positions noted, when the golfer again depresses and releases the pedal bar 39, the ball shown in FIG. 4 will be released and permitted to roll down the transit groove 54, under the gravitational impetus. The ball thus released, rolls down the transit groove 54 into the matching mat groove 60 in the hitting mat and comes to rest in the circular mat depression 62, immediately above and aligned with the reciprocating tee 88.

As shown in FIGS. 8 and 9, when a ball comes to rest within the mat depression 62, it seals the tee orifice 89 and prevents the passage of air from the supply 74 therethrough. When this happens, positive pressure from the supply 74, unable to escape, begins to fill the deflated chamber 76 formed by the base 78, the upper portion 84, and the membrane 87. As the chamber fills and expands, the unconfined upper portion 84 rises to the position shown in FIG. 9 and causes the tee 88 to lift the ball to its teed height above the mat.

The ball remains in teed position until it is struck off the tee by the golfer. Upon removal of the ball from the tee 88, air immediately escapes from the inflated chamber through the tee orifice 89 causing the chamber to instantly deflate and draw the tee 88 back into the mat orifice 63 to the position shown in FIG. 8.

Thereafter, every cycle of depression and release of the pedal bar 39 removes one ball from the flexible tubing 10 while another ball is teed up on the tee 88 ready for hitting by the practicing golfer. The approximate time lapse in a practical sequence from tripping the pedal bar to the ball fully teed position is approximately four seconds.

It will be obvious to persons who play golf that anytime the golfer wishes to hit from the synthetic grass surface 100, such as with iron clubs, he merely taps the ball from the mat depression 62 onto the synthetic grass inset. This will cause the tee 88 to remain beneath the surface of the mat 25.

Thus, the preferred embodiment of the invention has been illustrated and described. It must be clearly understood that the preferred embodiment is capable of variation and modification and is not limited to the precise details set forth. This invention contemplates all such variations and modifications as fall within the scope of the appended claims.

I claim:

1. A device for individually dispensing balls including, in combination, storage means for retaining a plurality of said balls preparatory to individual dispensement thereof, and feeder means for individually transmitting on demand each said ball from said storage means to a point of use, said feeder means including a single movable mechanical member which, in a first position contacts one of said balls and prevents movement thereof, and which, in a second position permits movement of said one of said balls toward said point of use while permitting another of said balls to move from said storage means into said feeder means ready for selective transmission on demand toward said point of use, teeing means proximate said point of use, said teeing means including means for selectively lifting each said ball transmitted by said feeder means from a first elevation at said point of use to a second elevation at said point of use under the influence of positive air pressure, said storage means including flexible tubing having a first open end communicating with a supply of said balls and a second open end in communication with said feeder means, said first open end being disposed at a higher elevation than said second open end for providing gravitational impetus tending to move said balls from said first open end to said second open end, said flexible tubing being wrapped into the form of an upstanding cylinder having a downward slope from said first end to said second end of approximately 1.8 inches per foot of length of flexible tubing.

2. The invention of claim 1, further including an upstanding hollow cylindrical member, said flexible tubing being wrappingly fixed around said cylindrical member, and further including a dish member having feeder channel means therein and mounted within said cylindrical member proximate said first open end of said flexible tubing.

3. The invention of claim 2 wherein said upstanding hollow cylindrical member has an aperture in a wall portion thereof, said aperture providing direct communication between said first open end of flexible tubing and said feeder channel means of said dish member for transmitting a supply of said balls from said dish member into said flexible tubing.

4. The invention of claim 1, wherein said feeder means further include support means for supporting said movable member upon a base member, said base member having transit groove means therein for permitting said balls to roll along said groove means from the position occupied when said movable member is in said first position toward said point of use.

5. The invention of claim 4, wherein said storage means include flexible tubing having a first open end communicating with a supply of said balls and a second open end adjustably attached to said base member such that said balls are rollable from said second open end directly onto said base member.

6. The invention of claim 5, further including deflector bar means fixed to said base member immediately proximate said second open end of said flexible tubing, said base member further including a depression for retaining said balls as they are issued from said second open end of said tubing, said deflector bar means contacting and directing said balls into said depression.

7. The invention of claim 6, wherein said feeder means further include stop plate member means for contacting and preventing balls from rolling out of said recess in said base member when said movable member is in said second position.

8. The invention of claim 7, wherein said feeder means further include terminal stop bar means for contacting said one of said balls concurrently with said movable member to prevent movement of said ball when said movable member is disposed in said first position.

9. The invention of claim 8, wherein said transit groove means is disposed in said base member along a straight line, said groove means having a proximal end including a sloping flared portion for containing said one of said balls prevented from moving by said movable member and said terminal stop bar means when said movable member is in said first position, said transit groove having a distal end coincident with an outermost edge portion of said base member.

10. The invention of claim 9 wherein the plane of movement of said movable member is normal to the line of said transit groove means and wherein said terminal stop bar is disposed at an angle approximately 10° with respect to the line of said transit groove means.

11. The invention of claim 9, wherein said movable member is pivotally mounted upon pivot means supported upon said base member, said movable member including a pedal bar portion and a rocking bar portion extending generally normally therefrom.

12. The invention of claim 11 including biasing means for constantly biasing said movable member toward said first position.

13. The invention of claim 4, wherein said support means include a pivot means and wherein said movable member is pivotally mounted upon said pivot means.

14. The invention of claim 4 wherein said movable member has a portion thereof for contacting said balls which portion is partially contoured to the shape of said balls.

15. The invention of claim 1, further including hitting mat means, said feeder means including a base member having transit groove means therein for permitting said balls to roll from a position occupied when said movable member is in said first position toward said hitting mat means, said hitting mat means including mat groove means for transmitting said balls from said transit groove means to said point of use.

16. The invention of claim 15 wherein said means for selectively lifting each said ball are disposed proximate said point of use and are partially covered by said hitting mat means, said hitting mat means including a mat orifice and a mat recess formed in said hitting mat means in alignment with said mat orifice and in communication with a terminal portion of said mat groove.

17. The invention of claim 16 wherein said teeing means include a cylindrical recess communicating at one end thereof with a source of air under positive pressure and communicating at another end thereof with said mat orifice, and expandable chamber means movably disposed within said cylindrical recess.

18. The invention of claim 17 wherein said teeing means further include a tee member affixed to a portion of said expandable chamber means and movable therewith, said tee member being normally disposed reciprocally movably within said mat orifice, said tee member protruding through said mat orifice and extending above a surface of said hitting mat when said expandable chamber is in a first expanded condition and said tee member retracting within said mat orifice beneath said surface of said hitting mat when said expandable chamber is in a second contracted condition.

19. The invention of claim 18 wherein said tee member includes a hollow tube portion, said expandable chamber means including a chamber base member and an upper portion member movable within said chamber cylindrical recess relative to said chamber base member, said upper portion member and said chamber base member being sealingly attached to one another by means of a flexible wall member, aperture means provided in said chamber base member in direct communication with said source of air under positive pressure for providing air under positive pressure to the interior of said expandable chamber.

20. The invention of claim 19 wherein said air under positive pressure in said expandable chamber is normally communicated to the ambient through said hollow tube portion of said tee member, said expandable chamber being in said contracted condition when it is communicated with the ambient and being in said expanded condition when said hollow tube portion of said tee member is blocked, said hollow tube portion being blocked by said balls when said balls are disposed within said mat recess.

21. The invention of claim 18 including means for selectively adjusting the minimum distance between the chamber base member and said upper portion member when said expandable chamber is in said contracted condition.

22. The invention of claim 18 including means for selectively adjusting the distance above the hitting mat surface to which the tee member can protrude.

23. The invention of claim 17 including nub means within said cylindrical recess for centering and spacing said expandable chamber means therewithin.

* * * * *